US011174630B2

(12) United States Patent
Bowron

(10) Patent No.: US 11,174,630 B2
(45) Date of Patent: Nov. 16, 2021

(54) MODULAR BUILDING STRUCTURE

(71) Applicant: Z-MODULAR HOLDING, INC., Chicago, IL (US)

(72) Inventor: Julian Bowron, Toronto (CA)

(73) Assignee: Z-MODULAR HOLDING, INC., Chicago, IL (US)

( * ) Notice: Subject to any disclaimer, the term of this patent is extended or adjusted under 35 U.S.C. 154(b) by 0 days.

(21) Appl. No.: 15/566,842

(22) PCT Filed: Apr. 14, 2016

(86) PCT No.: PCT/CA2016/050434

§ 371 (c)(1),
(2) Date: Oct. 16, 2017

(87) PCT Pub. No.: WO2016/165022

PCT Pub. Date: Oct. 20, 2016

(65) Prior Publication Data

US 2018/0135295 A1 May 17, 2018

Related U.S. Application Data

(60) Provisional application No. 62/147,915, filed on Apr. 15, 2015.

(51) Int. Cl.
*E04B 1/348* (2006.01)
*E04B 1/26* (2006.01)

(52) U.S. Cl.
CPC ..... *E04B 1/34838* (2013.01); *E04B 1/2604* (2013.01); *E04B 2001/266* (2013.01);
(Continued)

(58) Field of Classification Search
CPC ..... E04B 1/34838; E04B 1/2604; E04B 2001/2644; E04B 2001/266; E04B 2001/2676
See application file for complete search history.

(56) References Cited

U.S. PATENT DOCUMENTS 946,423 A 1/1910 Connaty
2,037,736 A * 4/1936 Payne ..... E04B 1/2604 403/173

(Continued)

FOREIGN PATENT DOCUMENTS

AU 2014221181 B2 8/2014
AU 2018204197 A1 7/2018

(Continued)

OTHER PUBLICATIONS

International Search Report for PCT/CA2016/050434 dated Jun. 23, 2016 (4 Pages).

(Continued)

*Primary Examiner* — Basil S Katcheves
*Assistant Examiner* — Omar F Hijaz
(74) *Attorney, Agent, or Firm* — Fitch, Even, Tabin & Flannery, LLP

(57) ABSTRACT

A connector that has a frame and a complementary column affixing pressure plate for coupling to the frame. The frame and the complementary column affixing pressure plate together forming a hollow body. The hollow body having a top end having an opening, a bottom end and side faces. The frame and complementary column affixing pressure plate having complementary apertures for receiving fasteners for affixing a column receivable within the hollow body from the top end. A joist plate coupled to the frame and a joist affixing pressure plate adapted for coupling to the joist plate. The joist plate and the joist affixing pressure plate having complementary apertures for receiving fasteners for affixing a joist. The connector can be used in construction of modular building and units.

19 Claims, 5 Drawing Sheets

(52) U.S. Cl.
CPC ..... *E04B 2001/2644* (2013.01); *E04B 2001/2676* (2013.01)

(56) References Cited

U.S. PATENT DOCUMENTS

| | | | | |
|---|---|---|---|---|
| 3,205,611 | A | 9/1965 | Onanian | |
| 3,416,270 | A | 12/1968 | McHugh | |
| 3,824,750 | A | 6/1974 | Antoniou | |
| 3,858,989 | A | 1/1975 | Field | |
| 3,973,855 | A | 8/1976 | Florence | |
| 4,003,144 | A | 1/1977 | Maddestra | |
| D248,447 | S | 7/1978 | Hornung | |
| D258,194 | S | 2/1981 | Stanley | |
| 4,620,404 | A | 11/1986 | Rizk | |
| 4,726,701 | A | 2/1988 | Thomas | |
| 4,758,111 | A | 7/1988 | Vitta | |
| 4,925,330 | A * | 5/1990 | Cornish | E04G 17/04 403/171 |
| 5,066,161 | A | 11/1991 | Pinney | |
| 5,127,759 | A | 7/1992 | Orbom | |
| 5,259,685 | A | 11/1993 | Gilb | |
| D357,544 | S | 4/1995 | Spransy | |
| 5,414,918 | A | 5/1995 | Pearson | |
| 5,440,844 | A | 8/1995 | Chihara et al. | |
| 5,516,225 | A | 5/1996 | Kvols | |
| 5,590,974 | A | 1/1997 | Yang | |
| 5,605,410 | A | 2/1997 | Pantev | |
| 5,727,358 | A * | 3/1998 | Hayashi | E04B 1/21 52/745.2 |
| 5,816,011 | A | 10/1998 | Kuramoto | |
| 5,820,289 | A | 10/1998 | Kern et al. | |
| 5,904,437 | A | 5/1999 | Allen | |
| 5,921,049 | A * | 7/1999 | Sugiyama | E04B 1/2604 403/230 |
| 6,062,761 | A | 5/2000 | Allen | |
| 6,092,849 | A | 7/2000 | Zambelli et al. | |
| 6,247,869 | B1 | 6/2001 | Lichvar | |
| 6,332,657 | B1 | 12/2001 | Fischer | |
| 6,334,286 | B1 | 1/2002 | Zambelli et al. | |
| 6,390,719 | B1 | 5/2002 | Chan | |
| 6,974,276 | B2 | 12/2005 | Kirchner et al. | |
| 7,503,623 | B2 | 3/2009 | Favaretto | |
| D622,865 | S | 8/2010 | Bajrami | |
| 7,882,388 | B2 | 2/2011 | Bramante | |
| 7,883,288 | B2 | 2/2011 | Jorna | |
| 7,941,985 | B2 | 5/2011 | Simmons | |
| 8,176,703 | B2 | 5/2012 | Tremacchi | |
| 9,121,433 | B1 | 9/2015 | Bacon | |
| D756,202 | S | 5/2016 | Leduc | |
| 9,334,642 | B1 | 5/2016 | Tanaka et al. | |
| 9,458,619 | B2 | 10/2016 | Bowron | |
| 9,845,595 | B2 | 12/2017 | Bowron | |
| 10,036,156 | B1 | 7/2018 | Macdonald et al. | |
| 10,450,737 | B2 | 10/2019 | Bowron | |
| D867,108 | S | 11/2019 | Bowron | |
| 2002/0007614 | A1* | 1/2002 | Katayama | E04C 3/292 52/838 |
| 2005/0034390 | A1 | 2/2005 | Dubensky et al. | |
| 2006/0112657 | A1 | 6/2006 | Abbot-Wilcox | |
| 2009/0087255 | A1 | 4/2009 | Jorna | |
| 2009/0307994 | A1 | 12/2009 | Cathcart et al. | |
| 2011/0219708 | A1 | 9/2011 | Ohnishi et al. | |
| 2011/0286121 | A1 | 11/2011 | Werner et al. | |
| 2011/0308063 | A1 | 12/2011 | Feeleus | |
| 2013/0045042 | A1 | 2/2013 | Ohlson | |
| 2013/0306808 | A1 | 11/2013 | Huang | |
| 2014/0286695 | A1 | 9/2014 | Jocham et al. | |
| 2014/0294500 | A1 | 10/2014 | Schaff et al. | |
| 2015/0184369 | A1 | 7/2015 | Carless | |
| 2016/0002909 | A1 | 1/2016 | Bowron | |
| 2017/0002559 | A1 | 1/2017 | Bowron et al. | |
| 2017/0044753 | A1 | 2/2017 | Bowron | |
| 2017/0089059 | A1* | 3/2017 | Farre Berga | E04B 1/1912 |
| 2018/0216336 | A1 | 8/2018 | Macdonald et al. | |
| 2019/0044753 | A1 | 2/2019 | Neeld | |
| 2019/0078321 | A1 | 3/2019 | Bowron | |
| 2019/0330838 | A1 | 10/2019 | Bowron | |

FOREIGN PATENT DOCUMENTS

| | | | | |
|---|---|---|---|---|
| CA | 2744074 | A1 * | 12/2011 | E04B 1/26 |
| CN | 2381869 | Y | 6/2000 | |
| CN | 101575876 | A | 11/2009 | |
| CN | 101680227 | A | 3/2010 | |
| CN | 101769008 | A | 7/2010 | |
| CN | 202559534 | U | 11/2012 | |
| CN | 202672346 | U | 1/2013 | |
| CN | 203834666 | U | 9/2014 | |
| DE | 249688 | A1 | 9/1987 | |
| DE | 19517785 | A1 | 11/1996 | |
| DE | 69704916 | A | 11/2001 | |
| EP | 0761 895 | A1 | 3/1997 | |
| EP | 0761895 | A1 | 3/1997 | |
| EP | 1683923 | A2 | 7/2006 | |
| EP | 2959067 | A4 | 12/2015 | |
| EP | 2759648 | B1 * | 1/2016 | E04B 1/2604 |
| ES | 2531702 | A1 * | 3/2015 | E04B 1/24 |
| GB | 2300432 | A | 11/1996 | |
| GB | 2554967 | A * | 4/2018 | E04B 1/2604 |
| JP | S52-094009 | U | 7/1977 | |
| JP | S62-031604 | U | 2/1987 | |
| JP | S63-179306 | U | 11/1988 | |
| JP | H03-066303 | U | 6/1991 | |
| JP | H03-224926 | A | 10/1991 | |
| JP | H03233042 | A | 10/1991 | |
| JP | H03267431 | A | 11/1991 | |
| JP | H04-098904 | U | 8/1992 | |
| JP | H04261733 | A | 9/1992 | |
| JP | H0642060 | A | 2/1994 | |
| JP | 3014203 | U | 5/1995 | |
| JP | H07180221 | A | 7/1995 | |
| JP | H07180228 | A | 7/1995 | |
| JP | 3014203 | U | 8/1995 | |
| JP | H07243239 | A | 9/1995 | |
| JP | H09194179 | A | 7/1997 | |
| JP | H09-278352 | A | 10/1997 | |
| JP | H10245929 | A | 9/1998 | |
| JP | H10331267 | A | 12/1998 | |
| JP | 2003293458 | A | 10/2003 | |
| JP | 2004270438 | A | 9/2004 | |
| JP | 2005-139623 | A | 6/2005 | |
| JP | 2006-063787 | A | 3/2006 | |
| JP | 2009024419 | A | 2/2009 | |
| JP | 2013-167131 | A | 8/2013 | |
| JP | 2013245501 | A | 12/2013 | |
| KR | 100923637 | B1 | 10/2009 | |
| KR | 20110053101 | A | 5/2011 | |
| KR | 201110053101 | A | 5/2011 | |
| KR | 10-1233559 | B1 | 2/2013 | |
| KR | 101676411 | B1 | 11/2016 | |
| TW | 294752 | B | 1/1997 | |
| WO | 9836134 | A1 | 8/1998 | |
| WO | WO-03069083 | A1 * | 8/2003 | E04B 1/2604 |
| WO | WO-2004035952 | A1 * | 4/2004 | E04B 1/2604 |
| WO | 2006096997 | A1 | 9/2006 | |
| WO | 2006122372 | A1 | 11/2006 | |
| WO | 2007144913 | A1 | 12/2007 | |
| WO | 2010035816 | A1 | 4/2010 | |
| WO | WO-2012083391 | A1 * | 6/2012 | E04B 1/18 |
| WO | 2012129601 | A1 | 10/2012 | |
| WO | 2014127472 | A1 | 8/2014 | |
| WO | 2015164975 | A1 | 11/2015 | |
| WO | 2016165022 | A1 | 10/2016 | |
| WO | 2017027965 | A1 | 2/2017 | |
| WO | 2018132921 | A1 | 7/2018 | |

OTHER PUBLICATIONS

Information on Search Strategy.

Chinese Office Action dated Jun. 19, 2018.

Extended European Search Report issued against International Application No. PCT/CA2016050954 dated Feb. 14, 2019.

(56) References Cited

OTHER PUBLICATIONS

Extended European Search Report issued against International Application No. PCT/CA2014050110 dated Jan. 20, 2017.
Office Action issued against corresponding Japanese Application 2017-508717 dated Feb. 26, 2019.
First Office Action and Search Report for corresponding Chinese Patent Application No. 201680027827.9 dated Apr. 15, 2019.
International Search Report for International Application No. PCT/CA2016/050954 dated Oct. 14, 2016, 5 pages.
Written Opinion of the International Searching Authority for PCT/CA2015050369 dated Jul. 14, 2015.
Office Action issued against corresponding Chinese Application No. 201480022662.7 dated Jul. 18, 2017.
Written Opinion issued by the Intellectual Property Office of Singapore for International Application No. PCT/CA2014/050110 dated May 2, 2016, 5 pages.
PCT International Search Report for International Application No. PCT/CA2014/050110 dated May 5, 2014, 4 pages.
Written Opinion issued by the Canadian Intellectual Property Office for International Application No. PCT/CA2016/050954 dated Oct. 14, 2016, 8 pages.
Extended European Search Report issued against corresponding International Application PCT/CA2015050369 dated Nov. 20, 2017.
Office Action issued against corresponding Japanese Patent Application No. JP2015-558313 dated Mar. 6, 2018.
International Search Report for International Application No. PCT/CA2018/050065 dated Apr. 16, 2018, 4 pages.
Written Opinion of the International Searching Authority for PCT/CA2018/050065 dated Apr. 16, 2018, 5 pages.
International Search Report for International Application No. PCT/CA2016/050434 dated Jun. 23, 2016.
Written Opinion of the International Searching Authority for International Application No. PCT/CA2014/050110 dated May 5, 2014.
Office Action issued against corresponding Indian Patent Application No. 201817005845 dated Sep. 14, 2020 with English translation (6 pages).
Certificate of Grant issued by IPOS for Singaporean Patent Application No. 11201801190R dated Oct. 14, 2020, in English (3 pages).
Office Action issued against corresponding Brazilian Patent Application No. BR112015020099 dated Jun. 2, 2020 in Portuguese (4 pages).
Certificate of Grant issued for corresponding Australian Patent Application No. 2018204197 dated Nov. 12, 2020 in English (1 page).
Office Action issued against corresponding Indian Patent Application No. 8541/DELNP/2015 dated Nov. 18, 2020 with English translation (6 pages).
Certificate of Patent issued for corresponding Japanese Patent Application No. 2018-218118 with English translation (10 pages).
Notice of Allowance issued for corresponding Mexican Patent Application No. MX/a/2015/010800 dated Jul. 27, 2020 with English translation (2 pages).
Notice of Allowance issued for corresponding South Korean Patent Application No. 10-2015-7026049 dated Nov. 20, 2020 with English translation (7 pages).
Office Action issued against corresponding Chinese Patent Application No. 201810153991.5 dated Aug. 31, 2020 with English translation (6 pages).
Office Action issued against corresponding Canadian Patent Application No. 2,901,755 dated Oct. 30, 2020 in English (4 pages).
Substantive Examination Clear Report issued against corresponding Malaysian Patent Application No. PI 2015002061 dated Nov. 12, 2020 in English (1 page).
Written Opinion and Search Report issued against corresponding Singaporean Patent Application No. 10201610543Q dated Sep. 8, 2020 in English (10 pages).
Office Action issued against corresponding Japanese Patent Application No. 2018-505507 dated Nov. 17, 2020 with English translation (6 pages).
Office Action issued against corresponding Brazilian Patent Application No. BR112018002870-3 dated Aug. 5, 2020 in Portuguese (4 pages).
Office Action issued against corresponding Chinese Patent Application No. 2016800526457 dated Jun. 9, 2020 in Chinese and English (8 pages).
Office Action issued against corresponding Japanese Patent Application No. 2018-526978 dated Aug. 21, 2020 in Japanese and English (14 pages).
Search Report issued against corresponding Brazilian Patent Application No. BR112016025375-2 dated Jul. 12, 2020 with English machine translation (11 pages).
Search Report issued against corresponding Chinese Patent Application No. 2019104842745 dated Oct. 27, 2020 with English translation (11 pages).
Communication under Rule 71(3) EPC issued for corresponding European Patent Application No. 15 785 510.7 dated Aug. 3, 2020 in English (6 pages).
Office Action issued against corresponding Indonesian Patent Application No. P00201607453 dated Apr. 30, 2020 with English machine translation (4 pages).
Office Action issued against corresponding Indonesian Patent Application No. P00201607453 dated Aug. 24, 2020 with English machine translation (4 pages).
Office Action issued against corresponding Japanese Patent Application No. 2017-508717 dated Nov. 24, 2020 with English machine translation (9 pages).
Office Action issued against corresponding Mexican Patent Application No. MX/a/2016/014274 dated Aug. 26, 2020 with English machine translation (6 pages).
Office Action issued against corresponding Chinese Patent Application No. 201880013277.4 dated Oct. 27, 2020 with English translation (42 pages).
Office Action issued against corresponding Indonesian Patent Application No. P00201904813 dated Sep. 14, 2020; English translation submitted herewith (4 pages).
English translation of Office Action issued against corresponding Japanese patent application 2018-218118, dated Dec. 17, 2019.
Substantive Examination Report issued by the Intellectual Property Corporation of Malaysia against corresponding Malaysian patent application PI 2016001907, dated Jan. 16, 2020.
Examination Report issued by Intellectual Property India against corresponding Indian patent application 201617036767, dated Feb. 21, 2020.
English translation of First Office Action issued against corresponding Japanese patent application 2017-508717, dated Dec. 24, 2019.
Form 2906 issued by EPO against corresponding EPO patent application 14 754 894.5, mailed Nov. 25, 2019 (in English).
First Examination Report issued against corresponding Australian Patent Application No. 2016247454 dated May 20, 2020 in English (8 pages).
Second Examination Report issued against corresponding Australian Patent Application No. 2016247454 dated Jun. 23, 2020 in English (9 pages).
IPOS Written Opinion issued against corresponding Singaporean Patent Application No. 11201906602S dated Sep. 4, 2020 in English (7 pages).
Office Action issued against corresponding Chinese Patent Application No. 201880013277.4 dated Oct. 27, 2020 in Chinese (13 pages).
Office Action issued against corresponding EP Patent Application No. 14 754 894.5 dated Apr. 16, 2021 in English (5 pages).
Notice of Grant of Patent issued for corresponding Chinese Patent Application No. 201810153991.5 dated Mar. 30, 2021 with English translation (4 pages).
Office Action issued against corresponding South Korean Patent Application No. 10-2021-7005101 dated Apr. 28, 2021 with English translation (7 pages).
Extended European Search Report issued against corresponding EP Patent Application No. 21152108.3 dated May 4, 2021 in English (7 pages).

(56) References Cited

OTHER PUBLICATIONS

Office Action issued against corresponding South Korean Patent Application No. 10-2016-7033280 dated Apr. 26, 2021 in English and Korean (23 pages).
Certificate of Grant issued for corresponding Malaysian Patent Application No. 2016001907 dated Oct. 27, 2020 in English (5 pages).
Office Action issued against corresponding Chinese Patent Application No. 201680052645.7 dated Feb. 2, 2021 with English translation (5 pages).
Office Action issued against corresponding Australian Patent Application No. 2016308775 dated Feb. 25, 2021 in English (2 pages).
Office Action issued against corresponding JP Patent Application No. 2018-526978 dated Apr. 22, 2021 with English translation (6 pages).
International Preliminary Report on Patentability issued for corresponding International Application No. PCT/CA2019/050960 dated Jan. 12, 2021 (4 pages).
Office Action issued against corresponding CN Patent Application No. 201880013277.4 dated May 27, 2021 with English translation (26 pages).
Office Action issued against corresponding IN Patent Application No. 201917030094 dated May 19, 2021 with English translation (7 pages).
Office Action issued against corresponding MX Patent Application No. MX/a/2017/013296 dated May 17, 2021 with English translation (10 pages).
Office Action issued against corresponding JP Patent Application 2018-505507 dated Jun. 14, 2021 with English translation (6 pages).
Office Action issued against corresponding CA Patent Application No. 2,901,755; dated Sep. 7, 2021 (3 pages).
Office Action issued against corresponding EP Patent Application No. 16836312.5 dated Aug. 27, 2021 (5 pages).

* cited by examiner

MODULAR BUILDING STRUCTURE

CROSS-REFERENCE TO RELATED APPLICATIONS

This application is a U.S. national phase application filed under 35 U.S.C. § 371 of International Application No. PCT/CA2016/050434, filed Apr. 14, 2016, designating the United States, which claims priority from the U.S. Provisional Patent Application No. 62/147,915, having the title MODULAR BUILDING STRUCTURE, filed Apr. 15, 2015, which are hereby incorporated herein by reference in their entirety for all purposes.

FIELD

The invention relates to a connector assembly, a hoistable connector assembly using the connector assembly, a method for coupling modular frame units having the connector assembly, a method of assembling a modular unit having the connector assembly and a building having the connector assembly.

BACKGROUND

Prefabricating modular building units constructed from standardized components in a controlled factory setting can be desirable due to the lowered costs and the increased quality which is obtainable in comparison to performing similar work on an outdoor construction job site.

Thus prefabricated modular building units having a floor, walls and an overhead structure, and which contain all the systems and furnishings pre-installed within them are preferred and well known in the art. Building assembly systems composed of the means and methods to join two or more modular building units together to form a larger structure are also well known in the art.

Devices which engage a specially prepared aperture on the upper or side surface of the structural frame so as to provide a releasable connection for the purpose of lifting and moving the modular building units are well known in the art.

A limitation to the construction of slender or tall buildings using factory-built modules is the inability of economically constructed modules to resist and transmit the large moments resulting from wind and seismic forces and the large compression loads resulting from the effect of gravity on the building and occupants. Further, all of these force types are exaggerated by narrowness in one or both axes of the building. These effects are greatest in the lower floors and rise in proportion to increasing height and slenderness, so forces are also largest at the lower floors. It is a characteristic of many modular construction systems that the pinned nature of the connections between adjacent modules and the lack of diagonal bracing beyond that necessary for integrity in shipping can limit the effectiveness of force transmission through a larger assembly of conventional module types.

The state of the art for constructing tall or slender building using modules as taught in the art cited herein is to maintain the economies of scale in production by either reinforcing the entirety of all modules of which the building is composed, so all contribute to resisting the forces in a distributed fashion as a stack of ocean freight containers do; or to employ large columns which are situated within or outside of the walls of all of the modules, creating an alternate load path; or to construct an adjoining or interconnected brace frame which by-passes the modules and transmits the large loads to the ground through the secondary structure; or to make use of a tension rod or cable which passes vertically through the building to anchor the modules against uplift and lateral drift. All of the above noted approaches can have limitations in the achievable resistance to forces and transmission of forces, or require the erection of an additional structure, which in turn can limit the achievable height or increases the amount of material used, therefore increasing the cost.

Additionally, methods of construction which employ large columns, particularly when grouped at corners or where occurring at intermediate locations within the walls result in larger spaces between modules, and/or walls of increased thickness which reduces the useful floor area of the resulting building, and/or projections which limit the free use of the voids and walls for the purposes of installing fixtures such as cabinets and shower stalls, and/or which imposes other limitations on the use of the space by the inhabitants, thereby decreasing the value of the resultant building.

Additionally, methods of modular building construction which employ secondary frames add to the assembly time for the building, increasing the cost and duration of construction and reducing the useful floor area, thereby decreasing the value of the resultant building.

Creating a multiplicity of dissimilar module types each having unique details relative to the forces acting on the module within a building is undesirable, as increased variation increases the number of unique components which must be measured, cut and inventoried until use. Additionally, setups of the manufacturing tooling required to accurately locate these parts relative to each other for assembly is error-prone and therefor normally executed by skilled persons, so any increase in the number of setups adds to both production time and cost.

Because the members comprising a networked structure must be of nearly identical length, creating the numerous features required to accurately assemble modules by coupling or other means, the subsequent location and connection of the subassemblies of which a module is made, the rigging and hoisting of the completed modules and the fastening of the modules to form structurally sound groupings which provide redundant and adequate load paths as currently practiced, requires a number of precision cutting and assembly operations which increase cost.

It is well known in the art that a moment-connected module frame or building frame reduces the need for diagonal reinforcing elements which otherwise obstruct the view of the occupants and hinder the installation and maintenance of building services. However moment connections which require expansive splice plates as a means of connection require clear access to one or more faces of the module, thus increasing the amount of enclosing and finishing work which must be completed at the site.

Some embodiments of a modular building which best suit the site conditions, the needs of the occupants and the aesthetic tastes of the architect or owner may be composed of module forms having non-orthogonal shapes, including tapering, curving, polygonal etc. however existing systems for the construction of structural modules suited to tall building construction are by nature not suited to non-orthogonal shapes.

Varying shapes of modules and the varying location of walls, fixtures and other components causes the centre of gravity of modules used to construct a building or to furnish a single floor of said building, to vary. To facilitate placement while reducing the clearances to a minimum it is desirable to have the side walls of the modules oriented as closely to perpendicular as possible during hoisting. It has been the case that lengthy delays and repeated trial lifts are required to effect adjustments of the rigging so as to achieve this desirable condition. The time required to make the required changes in turn increases the total duration of the hoisting operation, thus increasing costs for both labour and equipment such as cranes as well as delaying the completion of the building.

The requirement to place and inter-connect modules which are not accurate increases the amount of space required between modules, which increases the difficulty of fireproofing the structure and the difficulty of interconnecting the members so as to achieve the greatest possible strength as well as making integration of modules in to structural groups more difficult and wasting space and providing space for the circulation of sound, smoke and vermin.

The dimensions of a module and the positional disposition of the members within it defines the position and size of the outer wall facings, of the mechanical services, of the abutting and adjoining modules and of the support structures beneath the building and a such there is an interdependent relationship between all the elements of which a modular building is composed.

The present invention can help address the need for a compact, accurate, load-bearing, moment-connected, versatile and complete system of interrelated components for the orientation and assembly of module frames, which can facilitate quick and dependable rigging and hoisting of the completed modules and can provide for the connection of the modules to each other and to other necessary components of the building without the need for excessive unfinished areas so as to take full advantage of the structural properties of the modules and which defines and reduces the number of parts, provides features without the need for the fabrication of complex connections in the joining areas, excessive precision in the cutting of the required materials, the execution of difficult connections in difficult positions and a multiplicity of precision setups.

Specifically, the present invention consists of a system of components for the fabrication and assembly of building modules and to interconnect the modules to form buildings composed of those modules, together with a method for the definition of the number, selection and articulation of those components to be used in creating a modules suited to a specific configuration.

The present invention can also help to address the need for a system of components and work methods which allow a fabricator to economically and safely construct buildings of a wide range of types, from single family dwellings to towers of over 20 stories in a plurality of forms, including but not limited to orthogonal, tapering, radiating and curving shapes.

SUMMARY OF INVENTION

In one aspect, the specification relates to a connector, containing:

a frame and a complementary column affixing pressure plate for coupling to the frame, the frame and the complementary column affixing pressure plate together forming a hollow body, the hollow body having a top end having an opening, a bottom end and side faces; the frame and complementary column affixing pressure plate having complementary apertures for receiving fasteners for affixing a column receivable within the hollow body from the top end;

a joist plate coupled to the frame and a joist affixing pressure plate adapted for coupling to the joist plate, the joist plate and the joist affixing pressure plate having complementary apertures for receiving fasteners for affixing a joist.

In another aspect, the specification relates to a connector assembly, containing:

a first connector, the first connector as disclosed herein;

a second module connector; and a gusset plate sandwiched between the first connector and the second module connector.

In a third aspect, the specification relates to a hoistable connector assembly, containing the connector as disclosed herein and a lifting device detachably attachable to the connector.

In a fourth aspect, the specification relates to a liftable frame assembly, containing:

at least a pair of beams having an upper end and a lower end;

struts coupled to the at least pair of beams forming a liftable frame structure;

a plurality of first hoist blocks releasably affixed to the upper ends of the beams and slidably moveable from a first position to a second position on the beams when released;

load bearing cables coupled to the plurality of first hoist blocks;

a plurality of second hoist blocks releasably affixed to the lower end of the beams and slidably moveable from the first position to the second position of the beams when released; and a connector assembly as disclosed herein, coupled to the plurality of second hoist blocks on one end of the lifting connector assembly and to a modular frame unit on another end of the lifting connector assembly.

In a fifth aspect, the specification relates to a system of modular frame units for forming a modular building, containing:

a first module frame unit having a first end coupled to a first connector;

a second module frame unit having a first end coupled to a second connector; and the first connector and the second connector being coupled and sandwiching a gusset plate, wherein the first connector is as disclosed herein.

In a sixth aspect, the specification relates to a system for coupling adjacent modular frame units for forming a modular building, containing:

a first module frame unit having a first module frame unit first end coupled to a first module frame unit connector;

a second module frame unit positioned adjacent to the first module frame unit and having a second module frame unit first end having a second module frame unit connector; and a floor section having pedestals coupled to a slab, the pedestals having an opening adapted for coupling the pedestals to the first and second module frame unit connectors; and wherein the first module frame unit connector is the connector as disclosed herein, and having a bore in the hollow body adapted for receiving and coupling the pedestals.

In a seventh aspect, the specification relates to a system for vertically and horizontally joining modular frame units for forming a modular building, containing the system disclosed herein.

In a eight aspect, the specification relates to a method for coupling modular frame units for forming a modular building, containing:

coupling a first connector to a first end of first module frame unit;

coupling a second connector to a first end of second module frame unit; and sandwiching a gusset plate and coupling the first connector and the second connector to form modular frame units, wherein the first connector is as disclosed herein.

In a ninth aspect, the specification relates to a module frame unit containing the connector as disclosed herein.

In a tenth aspect, the specification relates to a building containing the module frame unit as disclosed herein, the connector as disclosed herein, or the connector assembly as disclosed herein.

BRIEF DESCRIPTION OF THE DRAWINGS

Reference will now be made, by way of example, to the accompanying drawings which show example embodiments of the present application, and in which.

Similar reference numerals may have been used in different figures to denote similar components.

DESCRIPTION OF EXAMPLE EMBODIMENTS

Figure 1:
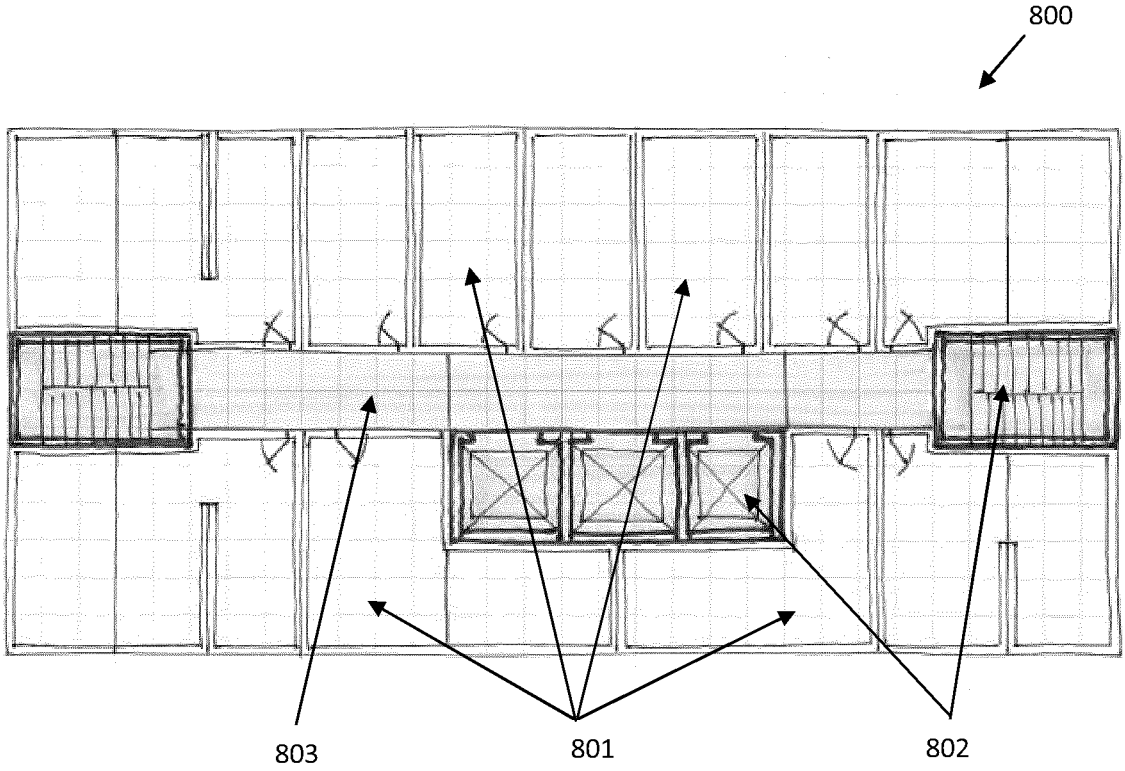
FIG. 1 is a plan view of a inhabitable structure having modular units.

Applications of the invention disclosed herein, and some related aspects, as would be recognized by a person of skill in the art, have been described and disclosed in a related PCT application numbers PCT/CA2014/050110 and PCT/CA2015/050369, filed Feb. 14, 2014 and Apr. 30, 2015, respectively, the subject matter of which is incorporated herein by reference.

The specification has been subdivided in to a section for each component or group of components for convenience in reading.

Corner Blocks

The current invention provides upper and lower load-bearing connectors or blocks which in one embodiment are corner blocks. In a particular embodiment, the blocks are substantially quadrilateral and in other embodiments have polygonal or asymmetrical shapes. These blocks can be mass-produced with features that provide a multiplicity of functions so as to concentrate the precision operations in a small number and size of objects and reduce the amount and complexity of work that must be performed on other members. The upper and lower blocks are of distinct forms and, in one embodiment, are located on the upper and lower ends of the vertical corner members (columns) of generally angular, tubular or built-up form, which perform the function of multi-story columns when modules so constructed are joined using the features on the blocks to form a larger or taller structure.

Likewise other features on the blocks engage the horizontal members of the building and perform the function of continuous horizontal members when modules so constructed are joined to form a larger or wider structure.

In a particular embodiment, the blocks have arms projecting at a plurality of angles including but not limited to perpendicular to the faces of the blocks providing for the location and attachment of adjoining members at a plurality of angles. In a particular embodiment, the present invention thus facilitates the fabrication and erection of modules including but not limited to orthogonal, tapering, radiating and curving shapes. The threaded and unthreaded holes in the arms achieve the positioning of threaded fasteners and the vertical walls of the arms provide an increase in the load-bearing capacity and transmission of the compression and tension forces created by the forces acting on the building and by the action of the fasteners.

In a particular embodiment, the blocks have holes in both the body and the arms for the passage and receiving of bolts with nuts or are threaded to receive bolts, so as to provide continuity of vertical tension through the columns and a moment resisting interconnection between adjacent modules or other building structures. The tension resistance resulting from the connection of the columns in the vertical plane enables the structure to resist uplift where it occurs and produces friction on the gusset plate so as to convey forces to the lateral members in the horizontal plane with a high level of fixity.

More specifically, during assembly, the surface of the arms which bear against the gusset plate from both above and below can be made tight.

In a particular embodiment, the bolts are accessible within the wall cavity or other such places and can be arranged flush or below the surface such that a removable patch can be easily configured to cover the location of the bolt and ensure continuity of the fireproofing materials surrounding the load-bearing structures.

The holes in the corner blocks provide a means of connection to tie-downs and hoisting devices. In a particular embodiment, the upper face of the block is prepared with an opening in to which a quick-release connector can be inserted so as to provide a means of quickly and dependably connecting and disconnecting the module to a lifting device.

Gusset Plate

Another component is a plate which is interposed between the blocks at the top and bottom ends of columns or groups of columns, which has upward-facing tapered locating pins for engaging and directing a descending module by sliding contact with a corresponding locating recess on the underside of a the corner block thus locating the module in the correct position for fastening. The plate also provides through holes for use in connecting adjacent modules with bolts to provide structural continuity in the horizontal plane both during construction and in the completed building and by virtue of its ductility, for accommodating slight variations in column length so as to ensure a continuous load path which bears equally on all members of the column group thus formed. As can be appreciated by someone knowledgeable in the art, the plate can be shaped to fit between a single vertical column or between two or more columns arranged in an orthogonal or other disposition. In a particular embodiment shims of a similar dimension and prepared with appropriate holes are placed in one or both sides of the connection to accommodate for variations in the finished dimensions of the modules thus maintaining the correct geometry of the modules stack.

Stairwells and Elevator Shafts

The system of the present invention allows for the fabrication of modules within which are installed stairs or elevating devices and which separate at the mateline between two modules without a significant visual or functional disruption.

Overheight Modules

The system of the present invention allows for the fabrication of modules which comprise the upper and lower halves of habitable volumes which are taller than shipping restrictions will normally allow and which are joined at the mateline between two or more stacked modules without a significant visual or functional disruption.

Hallways

Another group of components of the present invention is a structural hallway floor that is made from a suitable material such as reinforced concrete, sandwich plate, wood or formed metal together with supporting pedestals. In a particular embodiment, the slab is composed of reinforced concrete with reinforcement bars placed so that features on the support pedestals engage them so as to resist bending of the pedestals, thus creating a moment connection between stacks of adjacent modules thus connected. The pedestals are provided with holes that align with corresponding holes in the upper and lower corner blocks and serve to connect two parallel stacks of modules as well as connecting the adjacent columns within a stack on one side so as to create a combined load path. The pedestals and floor slabs may also be connected to the sides or ends of a stack of modules on one side of the slab and a balcony support frame on the outside to form a building with balconies or breezeways. The floor slab and pedestal assemblies can also be used as convenient carriers for building services such as ducts, pipes and wiring to facilitate the fabrication of these components off site in the factory environment.

System of Interdependent Detailing

The present invention also comprises a pre-determined grid upon which the dimensioning of the interconnected elements of subject building are based together with a system of fixtures which ensure the grid is maintained throughout all fabricated assemblies in all axes which ensures an accurate and interdependent relationship extending from corner blocks, to members, to subassemblies, to modules and to whole buildings in all axes. The dimensioning system thus serves to reduce fractional element and module sizing, to increase the number of common parts and to reduce the difficulty of coordination with foundation and podium contractors and which facilitates the work of all internal or external suppliers of components to be integrated in the modules so fabricated.

In a particular embodiment, the system is based on increments of no more or no less than two inches in three axes with a centre-to-centre accuracy between holes used for fastening of plus or minus 1/32" and an outside to outside dimensional accuracy of all mating surfaces of plus 0" minus 1/16".

Fixtures

The present invention includes a system for the assembly of the module frames which ensures that modules conform to the grid established above, and that no part of a module projects beyond the outermost ideal dimension, which increases the achievable speed of assembly and accuracy of the structure and, eliminates the possibility of additive dimensional drift, resulting in a reduction in the difficulty of erection, the difficulty of fireproofing, the possibility of interconnecting modules with a greater degree of fixity and a reduction in wall thickness and wasted space.

Table Fixture

A component of the system of the present invention is an adjustable fixture consisting of a flat table or a flat table mounted on trunions to allow pivoting, which is of sufficient thickness and prepared with a grid of holes to receive vertical pins so located as to orient the components of a module ceiling or floor frame for assembly coupling, thus creating module subassemblies such as floors, ceilings and walls. The locating holes are laid out so as to ensure that modules conform to the grid established above, which is coordinated with other building elements to ensure that the modules thus produced are easily assembled in to form a complete module and the complete module can be assembled to form a building. The pins are equipped with a system of spacers used in ensuring the correct elevation of the components of the assembly so as to produce flush conditions as required for the application of floor or ceiling surfaces. The fixture is thus configured to ensure that coupling is executed in a position ideal for the structure and so as to ensure that the completed parts do not exceed the tolerance envelope resulting in accumulating tolerance conditions.

Rotating Fixture

Another component of the present invention is an adjustable and rotatable fixture which orients a ceiling frame, a floor frame, the corner columns, the intermediate columns, the column reinforcements and the diagonal bracing, all of a plurality of dimensions; relative to each other for assembly so as to ensure that modules conform to the grid established above ensuring ease in the interconnection of modules and so as to ensure that the completed parts do not exceed the tolerance envelope and to ensure the parts can be oriented in a position ideal for the execution of the structural connections.

Quick Connect Hoisting Connector

Another component of the present invention is a releasable and compact quick-connector which is employed in the attachment of the hoisting apparatus to the module, which is installed in a specially prepared opening in the corner blocks, from above, without tools, which is resistant to being accidentally released and which can be removed without tools. In a particular embodiment, the connector is structurally ideal in that the upward-facing bearing surface of the toggle and the corresponding downward-facing bearing surface of the receiving block and the tension-loaded part of the toggle shaft which conveys the load from the bearing surface to the hoisting apparatus are in ideal proportion so as to maximize the load-bearing capacity of the combined elements within the most compact space and while maintaining the dimensional limits of the assembly within the top face of the corner block.

Hoisting Frame

Another component of the present invention is a hoisting apparatus which is arranged so as to suspend the load in an ideal posture for placement in the building, which in a particular embodiment is horizontal and which provides for the rapid adjustment of the position of all of the connection points from which lines pass to the crane hook so as to compensate for differences in the centre of gravity which occur in the length of a module. The device described also allows for altering the spread between pairs of cables on one side of the frame effecting a change in the dependent angle from vertical of the pair of lines which pass to the crane hook on one side of the module so as to move the centre of crane attachment to one side of the long axis of the frame so as to compensate for changes in the centre of gravity of loads which occur in the width of the module suspended from it.

Reinforcing Members

Further the invention comprise a system of standardized reinforcing members which connect with each other and with the columns, lateral framing, diagonal bracing and corner blocks described herein, eliminating the need for case-by-case design and fabrication or customization of reinforcement components.

Reinforcement Analysis

Further, the present invention comprises a work method for systematically analysing the forces acting on a building composed of modules, defining the optimum location for the application of the standardized reinforcing systems, selecting from a list of standardized reinforcements with progressive buckling and uplift resistance and thereby incorporating only such reinforcements as are minimally necessary to strengthen the areas under additional stress, without adding unnecessary structural material to more locations than required, without significantly disrupting the application of fireproofing materials and without requiring additional thickness of the walls of the module.

Built Up Columns

Further, the present invention comprises a method for the fabrication and connection of the outer columns so they form groupings with greater resistance to the compressive and tensile forces resulting from the loads encountered in the construction of tall and/or slender buildings.

Embodiments relating to the gusset plate, stairwells, elevator shafts, overheight modules, hallways, independent detailing, fixtures, hoisting connector, hoisting frame and reinforcing members are disclosed in PCT application numbers PCT/CA2014/050110 and PCT/CA2015/050369, filed Feb. 14, 2014 and Apr. 30, 2015, respectively, the subject matter of which is incorporated herein by reference.

Benefits

Increases Height without Frame

By eliminating the risk of inadvertently creating a connection which is not fully compressed during assembly and which is therefore not fully fixed, and by providing for a larger number of fasteners, and by facilitating the placement of the reinforcement, the system of components and work methods of the present invention can serve to increase the height of a building which can be built without the requirement for a secondary external or internal bracing frame, and to increase its useable floor area due to involving a larger portion of the members in the structural function and the enhanced fixity of the connections, the creation and assurance of multiple and redundant load paths, the integration of the brace frame in to the module walls and the resulting efficient transfer of the external, internal and self-loads imposed on the completed building through the adjacent modules and thence to the ground.

Increases Height with Frame

By reducing the amount of steel required in upper floors and thus its total weight, this invention can also serve to increase the height of a building which is built with the use of a secondary external or internal bracing frame of a given size.

Reduces Number of Unique Parts, Number of Locations and Size of Members

By analyzing the loads applied and more efficiently involving more of the required members in the structural function the invention also reduces the size of members required and limits the number, size and locations where unique reinforcement details and the related complexity of the fireproofing is required, thereby reducing the cost of such buildings.

Reduces Requirement for Precision

The present invention can help to further reduces the precision of the parts which must be made by workers in the modular production facility, which reduces the cost of the fabrication.

Reduces Complex Fabrication

The present invention concentrates many of the complex features required to join members, hoist modules and join modules in a single mass-produced component, helping to reduce both the complexity and the requirement for skilled work necessary to construct a module.

Allows Taller and Wider

Additionally the system can allow the building of taller modules composed of two stacked frames one of which has openings in the ceiling and the other of which has openings in the floor, longer modules due to the performance of the bracing and wider modules due to the improved behavior of the apertures in the ends, thus providing greater flexibility to designers of buildings so constructed.

Reduces Wall Thickness

By better perfectly distributing the load-bearing components the present invention can help to reduce the wall thickness required to accommodate structure and services.

Reduces Site Labour for Patching

By placing the tension connections within the wall cavity and concentrating the connection means in the vicinity of the column, the present invention can help to reduce both the number and the extent of the leave-out areas which must be subsequently patched.

The PCT applications noted herein relate to corner connectors that utilized hollow structural sections (HSS) made from steel; and where the connectors were welded to the HSS steel. In contrast, the subject application relates to connectors that are used for connection with wood to form a wood-based frame structure.

As there is an existing modular industry which uses predominately wood in solid form or as cross-laminated timber (CLT) and plywood sheets for the fabrication of habitable and utility modular structures it is desirable to be able to fabricate and stack modules made of wood together or in combination with modules made of steel to produce useful structures which benefit from the structural and cost advantages of the respective materials. The subject application relates to a connector for wood-framed modules which is compatible with the connection and fabrication systems for steel-framed modules as previously described in PCT application numbers PCT/CA2014/050110 and PCT/CA2015/050369, filed Feb. 14, 2014 and Apr. 30, 2015, respectively, the subject matter of which is incorporated herein by reference.

As should be understood by a person knowledgeable in the art, the assembly methods disclosed in the PCT applications, noted above, apply to structures built with the disclosed connector for wood-framed modules. Among other common features bolts which pass through a pair of opposed connectors and an intermediate gusset plate connect the modules vertically and laterally creating a structure which resists gravity loads, uplift and occupant loads, and the connector incorporates a hole in its lower face for receiving a locating pin.

The completed wood-framed modules so fabricated can be hoisted by similar hoisting frames, and the connectors and wood structures clad both inside and out with similar facade assemblies and finishes, as described in the PCT applications noted above and incorporated herein by reference.

The invention in accordance with an embodiment disclosed in the specification will now be described with reference to the accompanying drawings.

FIG. 1 is a plan view 800 of a typical residential, medical, office or other structure which is composed of a mixture of module types. In a particular embodiment, the modules 801 are fabricated from wood, 802 are fabricated from steel and 803 is an area with concrete deck, which may be cast in place of suitable supports, or pre-cast at a separate location and placed in the required location.

Figure 2:
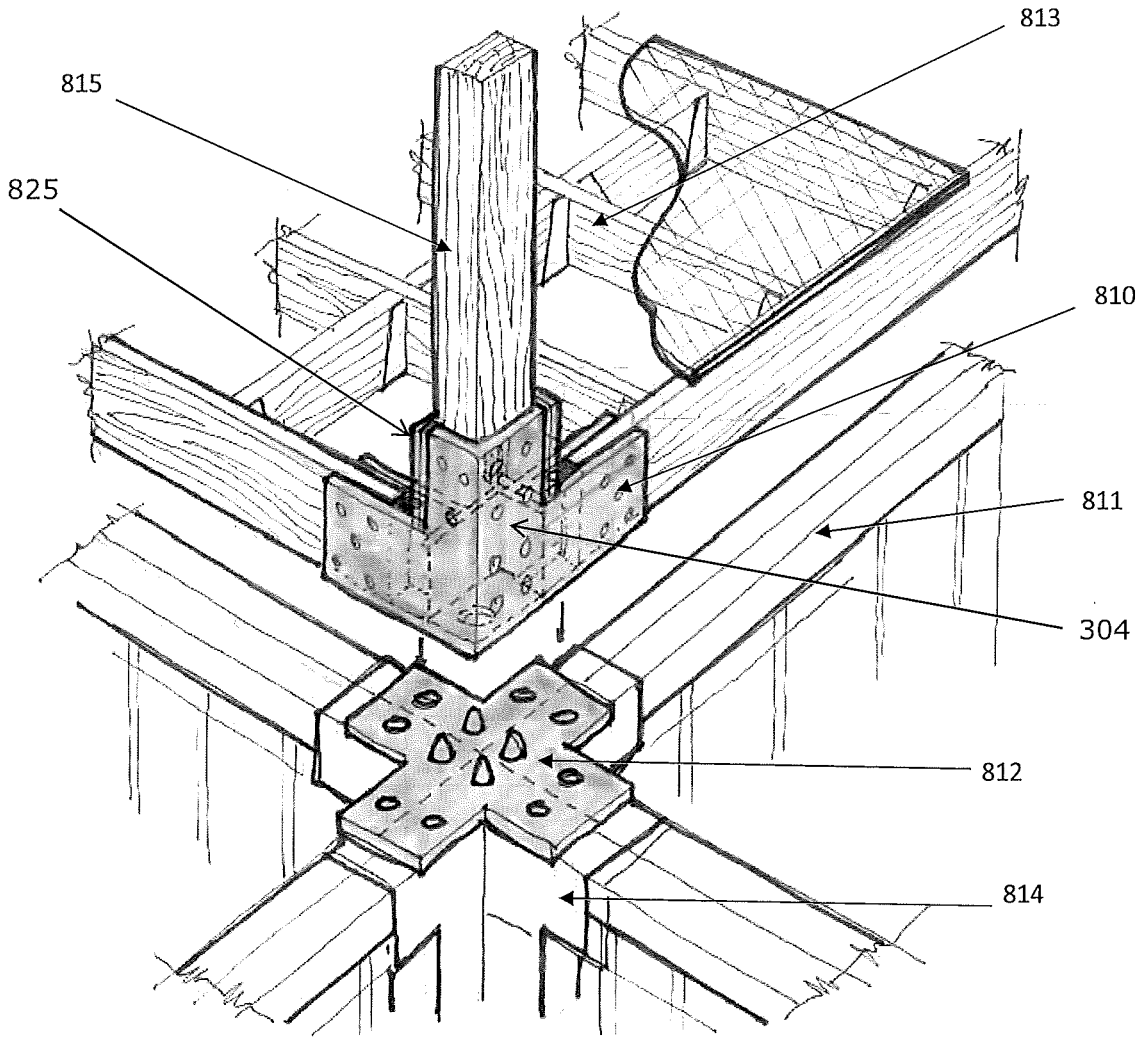
FIG. 2 is a perspective view of a corner portion of a modular structure in accordance with an embodiment disclosed herein.

FIG. 2 is a perspective view of an embodiment showing connector 810, the structure of wood framed module 813, load-bearing column 815, gusset plate with locating features 812, lower module 811 and upper connector of lower module 814. As noted above, the lower module 811 can be a connector adapted for use in a module frame, as disclosed herein, or alternatively, a connector that can be used for connection with a steel frame, as disclosed in the PCT applications noted above and incorporated herein by reference. The connector 810 shown is for coupling to a gusset plate 812 that can be attached to four corner connectors. As should be recognized by a person of ordinary skill in the art, the connector 810 can be coupled to a gusset plate that allows coupling of two adjacent modules.

Figure 3:
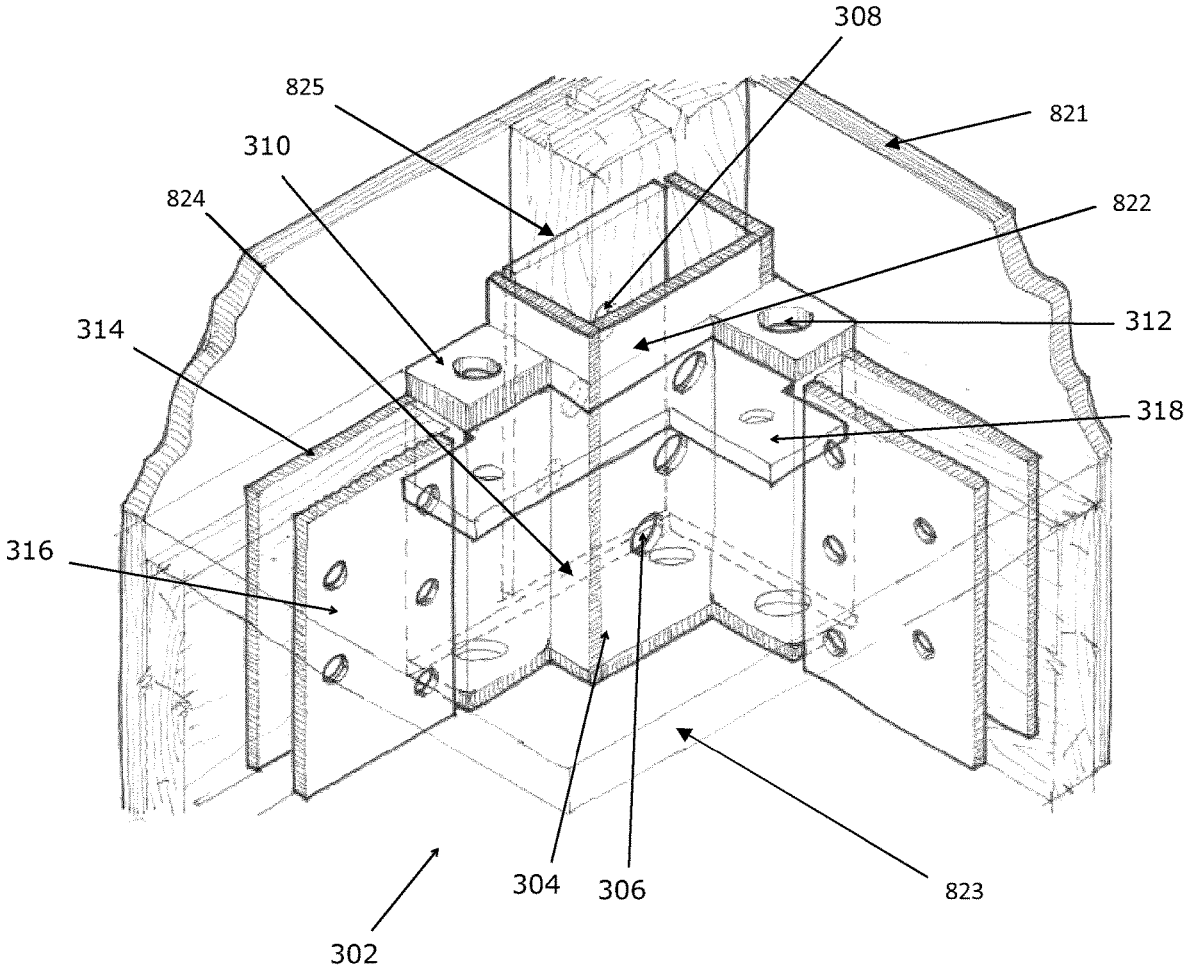
FIG. 3 is another perspective view of an inside face of the corner connector in accordance with an embodiment disclosed herein.

FIG. 3 is perspective view of a connector for wood framed modules fabricated from plates 824 which in a particular embodiment may be joined by welding, and in others may be joined by tabs and slots, spot welding or cast in one or more pieces, showing the body which receives the column 822, the plate which clamps the column 825, the outer module cladding material 821 and the floor decking 823. In the embodiment shown, the plates 824 together form a frame 304, which with a complementary column affixing pressure plate 825 form a hollow body 822. In the embodiment shown in FIG. 3, the frame 304 and the pressure plate 825 together form a quadrilateral cross-sectional hollow body, where a column 815 can be inserted into the hollow body. Although the pressure plate 825 disclosed in FIG. 3 leads to a hollow body 822 that has a nearly complete rectangular cross-section, the size and width of the pressure plate 825 can be varied depending upon design and application requirements, in such a manner that the edges of the pressure plate 825 are spaced from the edges of the frame 304.

In one embodiment, the pressure 825 is of rectangular shape and is separate from the frame 304 of the connector 302. Both, frame 304 and pressure plate 825 are provided with apertures (306 and 308, respectively) where a fastening means, for example and without limitation, bolts or screws, can be inserted for coupling the pressure plate 825 to the frame 304 to form the hollow body 822. In use, a column 815 is positioned into the frame 304 and the pressure plate 825 is pressed against the column 815 and fastening means are used to affix the column 815 within the hollow body 822 of the connector 302.

In the embodiment shown in FIG. 3, the hollow body 822 has a top end that has an opening, which provides the space for insertion of the column 815 into the connector 302. The hollow body 822 is also provided with side faces to which additional features, as described herein, are coupled and that can be used for affixing the joists or beams for forming the module. Moreover, the hollow body 822 has bottom end that can come in contact with, for example and without limitation, a gusset plate 812 (as shown in FIG. 2) or a floor decking 823 of a wood framed module (as shown in FIG. 3).

In the embodiment shown in FIG. 3, the frame 304 is provided with arms 310 that extend from the frame 304. The particular embodiment shown has two arms 310 that extend in perpendicular direction to provide a corner connector. However, as should be recognized by a person of ordinary skill in the art, the arms 310 can extend in opposing directions (i.e. at 180°). The arms 310 can be provided with holes 312 where bolts or other fastening means can be inserted for affixing the connector 302 to the gusset plate 812 or floor decking 823, which can be provided with complementary holes to receive the bolts or fastening means to affix the connector 302 to the gusset plate 812 or floor decking.

As shown in the embodiment disclosed in FIG. 3, the arms 310 have a top end that is spaced from the top end of the frame. However, as should be recognized by a person of skill in the art, the spacing can be varied depending upon the design and application requirements. In addition, the end of the arm 310 that is distal from the frame 304, each arm 310 is provided with a joist plate 314 that provides a backing surface where a joist, beam or other wooden frame structural material can be attached.

A joist affixing pressure plate 316 is also provided, which cooperates with the joist plate 314 to secure the joist, beam or other wooden frame structural material. Unlike the joist plate 314, and like the column affixing pressure plate 825, the joist affixing pressure plate 316 is provided as a separate piece. In other words, it is not directly attached or coupled to the connector 302, but cooperates with different features of the connector 302 to hold the joist, beam or other wooden frame structural material in place. In the embodiment shown in FIG. 3, analogous to the frame 304 and column affixing pressure plate 825, the joist affixing pressure plate 316 and joist plate 314 are provided with apertures that are aligned, and where fastening means can be inserted for affixing a joist, beam or other wooden frame structural material in place. By providing an independent column affixing pressure plate 825 and the joist affixing pressure plate 316, the connector can accommodate slight variations in the wooden frame and accommodate for the compressibility of the wooden frame structure, while affixing it securely to the connector to form a module.

The size and width of the joist plate 314 and the joist affixing pressure plate 316 is not particularly limited and can vary depending upon design and application requirements. In the embodiment shown in FIG. 3, the joist plate 314 and the joist affixing pressure plate 316 has a height about the height of the arms 310 or about the height of the joist. Moreover, when viewed from the top end towards the bottom end of the hollow body 822, the joist plate 314 and the joist affixing pressure plate 316 together with the ends of the arms 310 have a generally U-shaped structure.

The connector (FIG. 3) is also provided with a reinforcing rib 318 that is attached to the frame 304 of the connector 302. In the embodiment shown in FIG. 3, the reinforcing rib 318 is coupled to the frame 304 and the arms 310 extending from the frame 304. The means of coupling the reinforcing rib 318 is not particularly limited and should be known or can be determined by a person of skill in the art. In one embodiment, for example and without limitation, the reinforcing rib 318 welded to the frame 304. The reinforcing rib 318 can help to stabilize the connector 302 and also provide a surface on which a flooring or ceiling can be affixed. In addition, holes provided on the reinforcing rib can be used to affix the floor or ceiling by use of fastening means, as should be known or can be determined by a person of skill in the art.

FIG. 44 is a perspective view of a connector fabricated from plate, bent plate and angle 833, which in a particular embodiment may be welded, and in others may be joined by tabs and slots, spot welding or other suitable means. Analogous to the connector shown in FIG. 3, the connector 402 is provided with a frame 404 to which the different features of the connector couple to for forming the connector 402. In the embodiment shown in FIG. 4, the connector 402 is also provided with a column affixing pressure plate 5, which is formed as a bent plate (L-shaped). The frame 404 and pressure plate 5 are also provided with apertures (406 and 408, respectively) that are aligned to allow fastening means to be inserted to affix a column 7 within the hollow body 422. The hollow body 422 being formed when the pressure plate 5 and frame 404 are brought together.

Arrows 1 show the direction of clamping forces applied to the wood members by the clamping action of the through bolts 3, a typical vertical tension fastener 2, the pressure plates 4 which act on the horizontal members prepared for the passage of the bolts, the pressure plate 5 which acts on the column prepared for the passage of bolts, the wood or cross-laminated joists 6 and the wood or cross-laminated column 7. As should be recognized by a person of ordinary skill in the art, the perpendicular bolts being inserted into the hollow body 422 should be offset from one another to allow for the column to be affixed in the hollow body 422.

Figure 4:
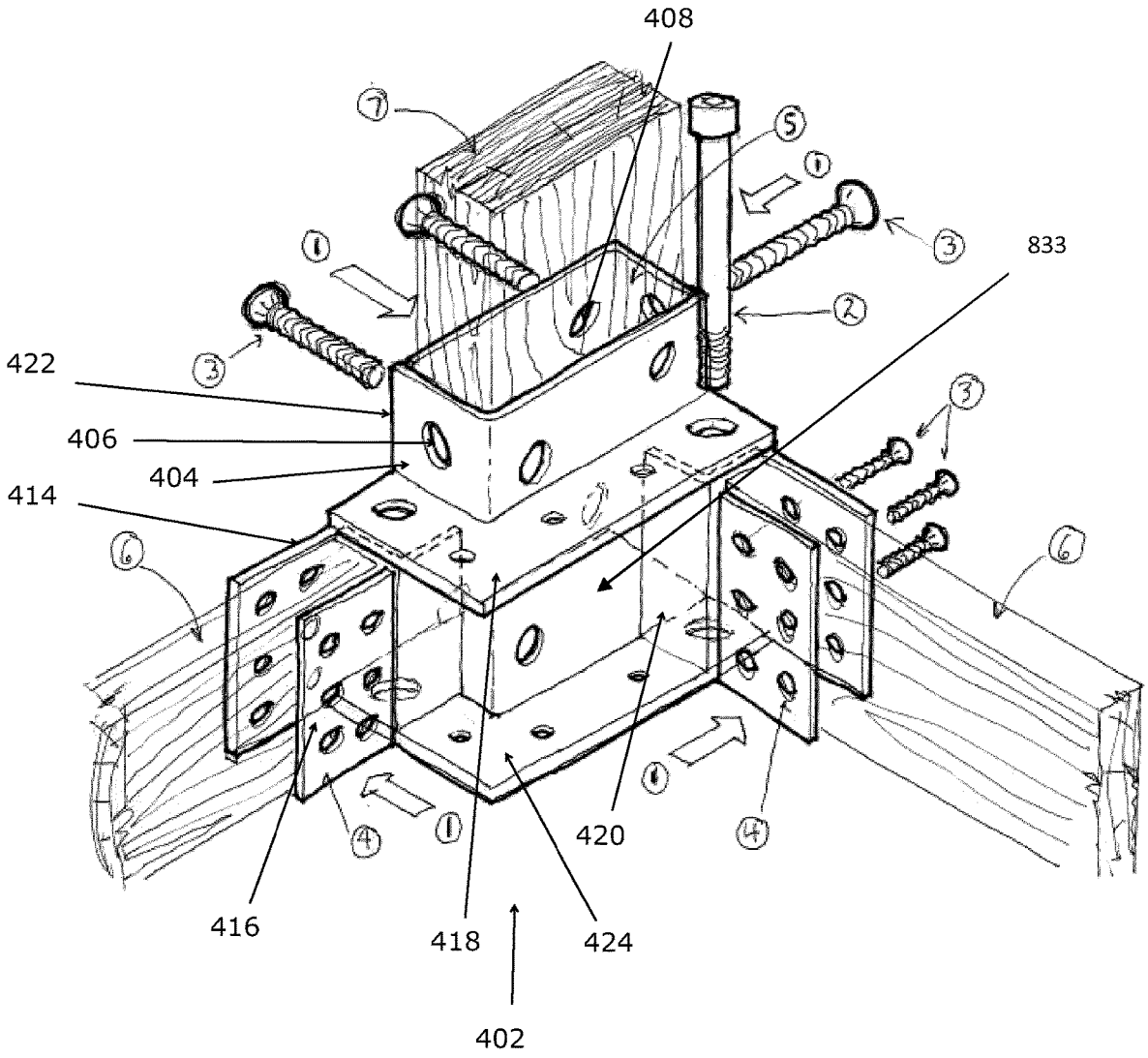
FIG. 4 is a perspective view of an inside face of the corner connector in accordance with second embodiment disclosed herein.

In contrast to the embodiment shown in FIG. 3, in the embodiment shown in FIG. 4, the joist plate 414 is directly coupled to and extends from the frame 404, with an angle or bent plate 420 being positioned between the reinforcing rib 418 and the bottom plate 424. Vertical tension fasteners 2 can be inserted in holes in the reinforcing rib 418. The reinforcing rib 418 having holes that are within the perimeter defined by the frame 404, joist plate 414 and bent plate 420. Joist pressure plate 416 are provided for affixing the joists 6 analogous to that described in the embodiment shown in FIG. 3.

FIG. 45 is an exploded perspective view of the connector shown in FIG. 4, which in a particular embodiment may be welded, and in others may be joined by tabs and slots, spot welding or other suitable means showing the reinforcing rib 10 which also acts as the top face of the connector. Also shown is the base 11 which bears upon the gusset plate, angles (or bent plate) 12, which in an alternate embodiment can be round or square tubes which transmit the vertical compression created by the tension bolts. The one-piece connector body 13 fabricated from bent plate and the pressure plates 14 which in a particular embodiment are prepared with a texture which increases the friction between the plate and the wood member and in another embodiment is covered in adhesive so as to increase resistance to slippage. As will be understood by a person knowledgeable in the art, the opposed face of the connector may be similarly prepared as may be the socket in to which the column is located.

Figure 5:
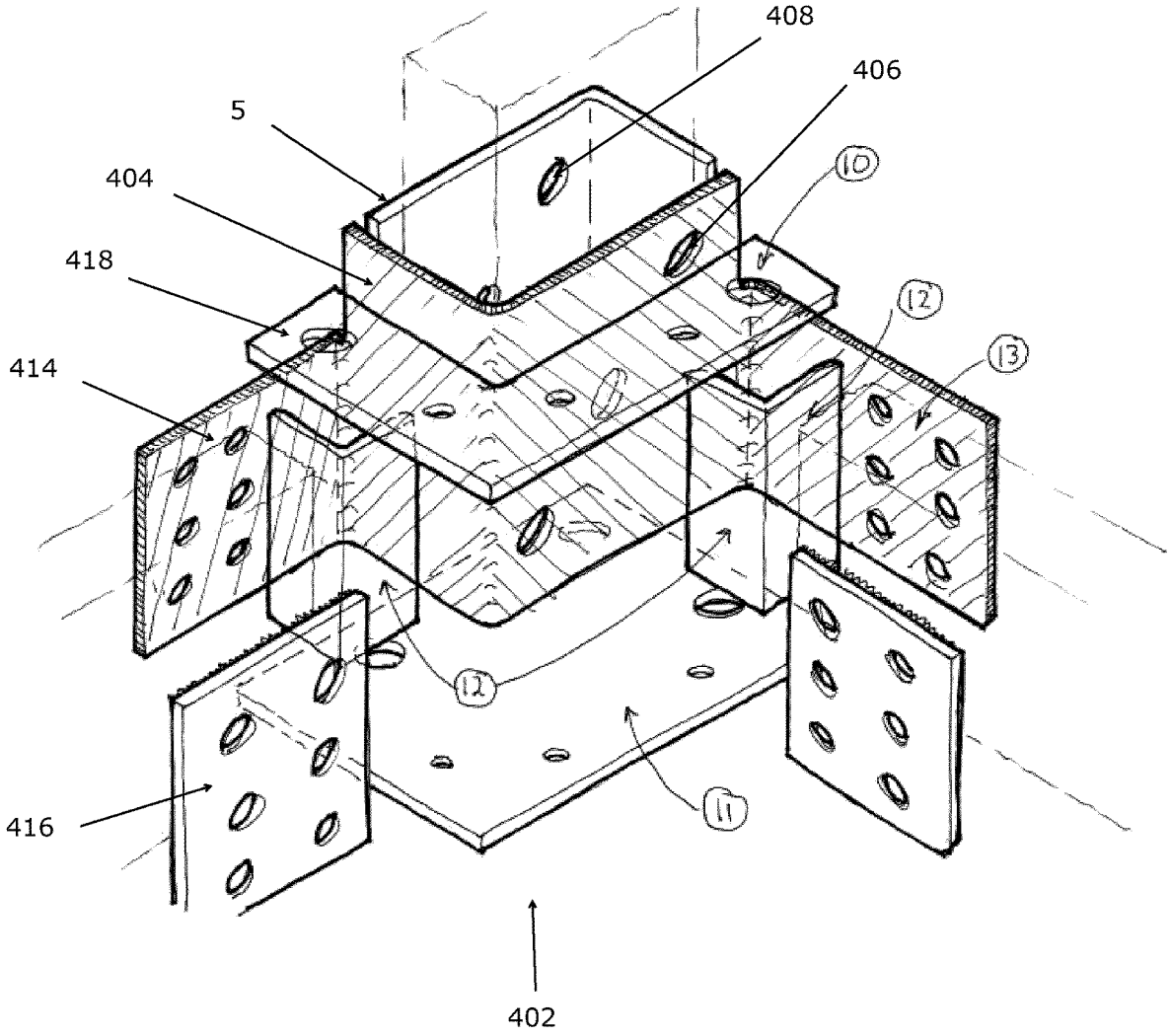
FIG. 5 is an exploded perspective view of an inside face of the corner connector in accordance with the second embodiment, disclosed herein.

As shown in FIG. 5, the frame 404 and the joist plates 414 together have a generally W-shaped structure, while the column affixing pressure plate 5, bent plate 12, reinforcing rib 10 are L-shaped. Although, FIG. 5 shows only the joist affixing pressure plates 416 as having a toothed surface to help with affixing the joist in place, it should be recognized by a person of ordinary skill in the art, that other surfaces, including the column affixing pressure plate 5 may be toothed as well.

The connector assembly can be formed by sandwiching the gusset plate between an upper connector and lower connector. The upper and lower connectors can be the same or different, and can have one of the connectors disclosed herein. The gusset plate has two faces, where the first face can be in contact with lower connector and the second face can be contact with the upper connector. In addition, the gusset plate is provided with through holes, which align with apertures on the upper connector and lower connector, allowing fastening of the connectors using fastening means. The fastening means is not particularly limited, and can include nut and bolts, screws.

The outer faces of connector body can have a plurality of holes (or bores) which are threaded or unthreaded as required by circumstances for use in the connection of column groups, hallway slabs, fixtures, hoisting means or other useful features through the use of bolts, pins, clips, joining plates or other fastening means. In another embodiment, the connector is taller and additional holes are provided for the use of additional fasteners or the addition of additional bracing or other features. In another embodiment, the connector is more or less than 4-sided and not quadrilateral, but rather has trapezoidal, parallelogram or other shapes so as to facilitate the production of round, curving, tapering, star-shaped or other building forms.

In one embodiment, the gusset plate is cut from steel plate or other material having adequate thickness and mechanical properties for the intended function. In a further embodiment, it is ⅜" thick. The gusset plate has through holes, countersunk holes and at least one locating pin. Flathead screws passed through holes and threaded in to holes in upper connector accurately unite adjacent columns and thus whole modules. The ductility of plate in the vertical plane can help ensure that the column groups are acting together to sustain large loads. The precision of the location of holes for the flathead screws and the corresponding holes in the connectors can help ensure module-to-module tolerances are maintained and controlled.

The gusset plate can be sized to fit on top of 1, 2, 3, 4 or more columns providing equivalent vertical separation in all locations and forming groups of 2, 3, 4 or more modules. The gusset plate can be provided with one or more pins on the face contacting the lower connector. The locating pins can engage with a locating pin receiving aperture positioned on the lower connector body gusset contact face, which can help with proper positioning of the lower connector.

A suitable material such as fibre-cement board, or steel sheet deck and concrete toping, or steel-composite sheet decking is applied to the top face of the floor beams of the module floor thus built, and fastened appropriately, or concrete or other material is filled between the framing so as to support occupant loads and provide the necessary diaphragm action to the module and in turn to a building composed of modules. Similarly, material such as drywall or fire-proof board and insulation of a variety of types depending on conditions is applied to the surfaces of the framing and boards and in voids in walls and ceilings to provide a variety of functions such as privacy to the occupants, to provide fireproofing to the structure and to limit the transmission of sound.

Additionally, the configuration of the connector of the present invention provides for a greater number of fasteners so as to increase the tension capacity of the connection as well as providing a greater area for the connection of supplementary reinforcing members which increase both the buckling resistance and the tension capacity of the structure so produced.

Certain adaptations and modifications of the described embodiments can be made. Therefore, the above discussed embodiments are considered to be illustrative and not restrictive.

Parts List

| No. | Description |
|---|---|
| 1 | Arrow indicates direction of clamping force created by clamping bolts |
| 2 | Vertical tension fastener with function as previously described |
| 3 | Clamping bolts |
| 4 | Pressure plates for joists |
| 5 | Pressure plate for column (bent embodiment shown) |
| 6 | Wood or cross-laminated-timber joists |
| 7 | Wood or cross-laminated-timber column |
| 10 | Reinforcing rib and top face of connector |
| 11 | Bottom face of connector |
| 12 | Angles or tubes to transmit compression |
| 13 | One-piece bent plate connector body |
| 14 | Embodiments of pressure plate with shear-enhancing texture and/or adhesive |
| 302 | Connector |
| 304 | Frame |
| 306 | Aperture on frame |
| 308 | Aperture on pressure plate |
| 310 | Arms |
| 312 | Holes in arms |
| 314 | Joist plate |
| 316 | Joist affixing pressure plate |
| 318 | Reinforcing rib |
| 402 | Connector |
| 404 | Frame |
| 406 | Apertures on frame |
| 408 | Apertures on pressure plate |
| 414 | Joist plate |
| 416 | Joist affixing pressure plate |
| 418 | Rib |
| 420 | Bent plate |
| 422 | Hollow body |
| 424 | Bottom plate |
| 800 | Floor plan of a single or multi-story habitable structure |
| 801 | Areas of the building built with wood-framed modules |
| 802 | Areas of the building built with steel-framed modules |
| 803 | Areas of the building decked with pre-cast or site-cast concrete |
| 810 | Connector for wood-framed modules |
| 811 | Top of module below |
| 812 | Gusset plate with locating features |
| 813 | Floor structure of wood-framed module |
| 814 | Upper connector of module below |
| 815 | Column of wood-framed module |
| 821 | Outer cladding of wood-framed module |
| 822 | Body of wood framed module connector |
| 823 | Floor decking of wood framed module |
| 824 | Wood framed module connector fabricated from plates |
| 825 | Pressure plate for column (flat embodiment shown) |
| 833 | Body of wood framed module connector fabricated from angles, plates and bent plates |

What is claimed is:

1. A connector assembly, comprising:

a first connector, wherein the first connector comprises a frame and a complementary column affixing pressure plate for coupling to the frame, the frame and the complementary column affixing pressure plate together forming a hollow body upon coupling, the hollow body having a top end having an opening, a bottom end and side faces;

the frame and complementary column affixing pressure plate having complementary apertures for receiving fasteners for affixing a column receivable within the hollow body upon insertion into the opening from the top end; and a joist plate coupled to the frame and a joist affixing pressure plate adapted for coupling to the joist plate, the joist plate and the joist affixing pressure plate having complementary apertures for receiving additional fasteners for affixing a joist;

a second module connector; and a gusset plate sandwiched between the first connector and the second module connector.

2. The connector according to claim 1, wherein the joist plate and the joist affixing pressure plate have a generally U-shaped cross-section.

3. The connector according to claim 1, wherein the frame and a pair of joist plates together have a generally W-shaped cross-section.

4. The connector assembly according to claim 1, wherein the joist affixing pressure plate has a toothed face.

5. The connector according to claim 1, further comprising a reinforcing rib engaging the side faces of the frame and positioned at a top end of the joist plate.

6. The connector according to claim 1, further comprising a bottom plate and a compression transmitting angle or tube, the compression transmitting angle or tube positioned between the rib and the bottom plate.

7. The connector according to claim 6, wherein the compression transmitting angle or tube is an L-shaped angle that engages the frame at one end and the joist plate at another end.

8. The connector according to claim 1, further comprising arms coupled to the frame with the joist plate extending from the arms.

9. The connector assembly of claim 1, wherein the gusset plate has holes for receiving coupling means or fastening means to couple the first connector and the second module connector.

10. The connector assembly of claim 1, further comprising a locating pin positioned on a first face of the gusset plate for engaging a locating pin receiving aperture on the first connector for positioning the first connector on the gusset plate.

11. A liftable frame assembly, comprising:

at least a pair of beams having an upper end and a lower end;

struts coupled to the at least pair of beams forming a liftable frame structure;

a plurality of first hoist blocks releasably affixed to the upper ends of the beams and slidably moveable from a first position to a second position on the beams when released;

load bearing cables coupled to the plurality of first hoist blocks;

a plurality of second hoist blocks releasably affixed to the lower end of the beams and slidably moveable from the first position to the second position of the beams when released; and a connector assembly as defined in claim 1, coupled to the plurality of second hoist blocks on one end of the lifting connector assembly and to a modular frame unit on another end of the lifting connector assembly.

12. A system of modular frame units for forming a modular building, comprising:

a first module frame unit having a first end coupled to a first connector;

a second module frame unit having a first end coupled to a second connector; and the first connector and the second connector being coupled and sandwiching a gusset plate, wherein the first connector is as defined in claim 1.

13. A system for vertically and horizontally joining modular frame units for forming a modular building, comprising the system as defined in claims 11 or 12.

14. A system for coupling adjacent modular frame units for forming a modular building, comprising:

a first module frame unit having a first module frame unit first end coupled to a first module frame unit connector;

a second module frame unit positioned adjacent to the first module frame unit and having a second module frame unit first end having a second module frame unit connector; and a floor section having pedestals coupled to a slab, the pedestals having an opening adapted for coupling the pedestals to the first and second module frame unit connectors; and wherein the first module frame unit connector is the connector as defined in claim 1, and having a bore in the hollow body adapted for receiving and coupling the pedestals.

15. A method for coupling modular frame units for forming a modular building, comprising:

coupling a first connector to a first end of first module frame unit;

coupling a second connector to a first end of second module frame unit; and sandwiching a gusset plate and coupling the first connector and the second connector to form modular frame units, wherein the first connector is defined in claim 1.

16. A module frame unit comprising a connector assembly as defined in claim 1.

17. A building comprising the module frame unit of claim 16.

18. A building comprising the connector as defined in claim 1.

19. A building comprising the connector assembly as defined in claim 1.

* * * * *